United States Patent [19]

Davin et al.

[11] Patent Number: 4,708,519

[45] Date of Patent: Nov. 24, 1987

[54] ASPHALT PAVING MACHINE WITH LIFTABLE, ADJUSTABLE AUGER MECHANISMS

[75] Inventors: Donald R. Davin, Shelbyville; Robert L. Brown, Mattoon, both of Ill.

[73] Assignee: White Consolidated Industries, Inc., Cleveland, Ohio

[21] Appl. No.: 848,719

[22] Filed: Apr. 4, 1986

[51] Int. Cl.[4] ..... E01C 19/12

[52] U.S. Cl. ..... 404/101; 404/108; 414/503

[58] Field of Search ..... 404/96, 101, 102, 105, 404/106, 108; 414/502, 503, 526

[56] References Cited

U.S. PATENT DOCUMENTS

| | | | |
|---|---|---|---|
| 1,993,656 | 3/1935 | Gardiner | 404/106 |
| 2,346,379 | 4/1944 | Jackson | 404/102 X |
| 2,583,108 | 1/1952 | Lewis | 404/101 |
| 2,589,256 | 3/1952 | Horning | 404/101 X |
| 3,130,654 | 4/1964 | Apel et al. | 404/105 X |
| 3,584,547 | 6/1971 | Davin | 404/83 |
| 3,699,855 | 10/1972 | Leister | 404/108 |
| 3,874,807 | 4/1975 | Puckett et al. | 404/110 |
| 3,901,616 | 8/1975 | Greening | 404/102 |
| 3,907,451 | 9/1975 | Fisher et al. | 404/101 |

*Primary Examiner*—Stephen J. Novosad
*Assistant Examiner*—Matthew Smith
*Attorney, Agent, or Firm*—Schweitzer & Cornman

[57] ABSTRACT

An improved mounting arrangement for the auger and auger drive mechanism of a floating screed type asphalt paver. A drive box, pivotally mounted at the back of the paver, supports and drives the inboard ends of left side and right side augers. A cantilever beam, mounted on the drive box, extends laterally over both augers and provides outboard bearing support. Actuator means is provided for controllably pivoting the entire assembly about an axis located in front of the augers, enabling the augers to be lifted and lowered for loading/unloading operations, clearing obstructions, etc., and also enabling the auger to be adjusted vertically during paving.

20 Claims, 8 Drawing Figures

ASPHALT PAVING MACHINE WITH LIFTABLE, ADJUSTABLE AUGER MECHANISMS

BACKGROUND AND SUMMARY OF THE INVENTION

The invention is directed generally to improvements in asphalt pavers of the floating screed type. In particular, the invention is directed to improvements in the mounting and positioning of the auger mechanisms typically employed with such pavers.

In the laying of asphalt pavement roadways, it is common practice to utilize floating screed type paving machines. These machines typically include a tractor-like vehicle having an engine for propulsion and for material distributing functions. A material receiving hopper is provided at the front of the paver, arranged to receive hot asphalt materials from a truck, as the paving machine advances along the roadbed. Means, such as slat conveyors, are provided to convey the asphalt material rearward from the hopper and to deposit the material on the roadway, in front of the floating screed.

Directly in front of the screed, there is provided a distributing auger mechanism, comprising left and right side augers positioned in the region in which the asphalt is deposited from the slat conveyors. As the machine advances along the prepared roadbed, the raw asphalt material is first deposited by the slat conveyors and then distributed laterally outward by the augers. The distributed material then flows under the floating screed, which levels, smooths and compacts the asphalt to provide a continuous, level pavement mat.

Conventionally, the auger elements are mounted at the back of the paver in a substantially fixed position. While means typically may be provided to enable limited vertical adjustment of the augers, the nature of the known equipment is such that adjustments are rarely if ever be utilized after the initial setting. Historically, height adjustment of the auger mechanism has involved multiple manual adjustments of turnbuckles and bearing mounts, in some instances at locations which may be heavily coated with asphalt. Accordingly, adjustment of the auger height with the paver on the move has been altogether out of the question, and adjustment at other times is sufficiently complex and time consuming as to rule it out for most purposes.

In accordance with the present invention, a novel and improved arrangement is provided for constructing and mounting the auger and auger drive mechanisms for limited vertical liftability and height adjustment relative to the tractor frame, such that the auger can be instantly and effortlessly raised or lowered relative to the paver.

One of the important advantages of the mechanism of the invention resides in the fact that the auger may be set relatively close to the roadbed for normal paving operations, to achieve optimum function during paving, and yet may be instantly raised to clear roadbed obstructions, for example, such as manhole projections. In addition, for loading of the paver onto a low boy trailer or the like, for transportation to a new site, it is possible to quickly raise the auger mechanism up out of the way, providing sufficient clearance at the back of the paver to enable it to travel up a sharp incline onto the trailer bed without damaging the auger mechanism.

Pursuant to one aspect of the invention, the new liftable auger mechanism includes a drive box, which is mounted centrally, at the back of the paver, and supports the inboard ends of each of the left and right side auger elements. Support for the outboard ends of the augers is provided by means of a laterally extending cantilever beam, which is carried by the drive box and extends outward over the top of the auger elements. At one or more outboard locations, depending upon the length of the auger elements, support bearings are provided, extending downward from the cantilever beam.

In a preferred form of the invention, the entire auger mechanism is supported for limited movement by pivotal attachment of the drive box to the back of the paver frame. A hydraulic lift mechanism engages the cantilever beam at relatively widely spaced points, on opposite sides of the drive box, in order to pivot the assembly. The pivot axis of the drive box is located forwardly of the auger and generally at the same horizontal level, such that pivoting movement of the drive box is translated into generally vertical movement of the augers.

Desirably, the laterally extending cantilever beam is movably supported by the paver frame at spaced outboard locations, to provide for mechanical stability of the entire structure. Additionally, thrust resisting means may be provided respectively on the cantilever beams and paver frame, to assist in resisting the unbalanced sideways thrusting forces developed by the augers during normal paving operations.

To advantage, the new auger mechanism is constructed as a substantially unitary module, which can be installed on and removed from the paver substantially as a single unit, greatly facilitating assembly, maintenance and repair operations.

For a more complete understanding of the above and other features and advantages of the invention, reference should be made to the following detailed description of a preferred embodiment and to the accompanying drawings.

DESCRIPTION OF A PREFERRED EMBODIMENT OF THE INVENTION

Figure 1:
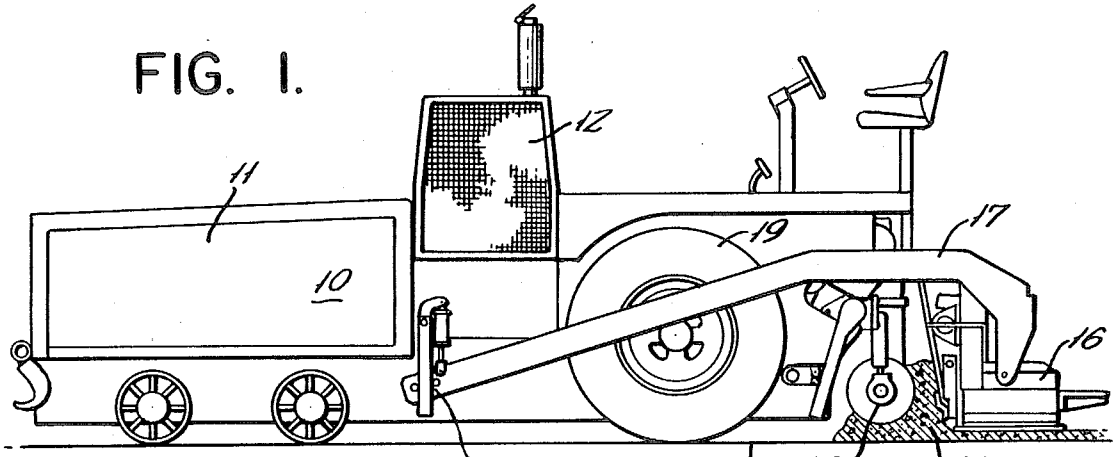
FIG. 1 is a simplified, side elevational view of a typical form of floating screed type of asphalt paver.

Referring now to the drawing, and initially to FIG. 1 thereof, the reference numeral 10 indicates generally an asphalt paver of the floating screed type. The illustrated paver, utilizing large diameter, pneumatically tired drive wheels 19, may be of the general type described in the Davin U.S. Pat. No. 3,584,547 and marketed commercially by Blaw-Knox Construction Equipment of Mattoon, Illinois. A common alternative form of floating screen asphalt paver is also shown in the Davin U.S. Pat. No. 3,776,326, which utilizes endless tracks rather than pneumatically tired wheels for propulsion. The improved auger mechanism of the invention is utilizable to advantage in either form of paver and, indeed, may be useful to advantage in pavers other than floating screed pavers, for example.

A paver of the type illustrated in FIG. 1 typically is provided with a hopper 11 in its front section, which is arranged to receive hot asphalt material from a dump truck located directly in front of the paver and typically pushed down the roadway by the paver during paving operations. An engine 12 provides motive power for the paver. Conventionally, conveyor means are provided to move the hot asphalt material from the area of the hopper 11 rearward, to be discharged at the back of the machine, as indicated at 13. Since the area being paved is usually of considerably greater width than the effective width of the material conveyors, and frequently considerably greater than the width of the paver apparatus as a whole, it is conventional to provide auger elements 14 at the back of the paver, carried slightly above the roadway surface 15. These augers are controllably driven in a manner to distribute the hot asphalt laterally outward from the central region in which the material is discharged by the conveyors.

A floating screed 16 is positioned immediately behind the auger means 14 and is connected to the paver frame by spaced towing arms 17. The towing arms are pivotally connected to the paver frame at tow points 18, which may be adjusted vertically upward and downward in accordance with known principles to control the attitude of the screed 16.

In the illustrated form of the invention, a drive box 20 is pivotally mounted at the back of the paver 10 and serves to both mount and support the respective left and right side augers 21,22. The augers themselves may be of conventional construction, comprising internal shafts 23,23*a* on which are mounted a plurality of auger segments 24, which can be arranged in succession to form a more or less continuous helix. Commonly, paddle devices 25,26 are provided at the inboard and outboard extremities of the auger shafts.

Figure 3:
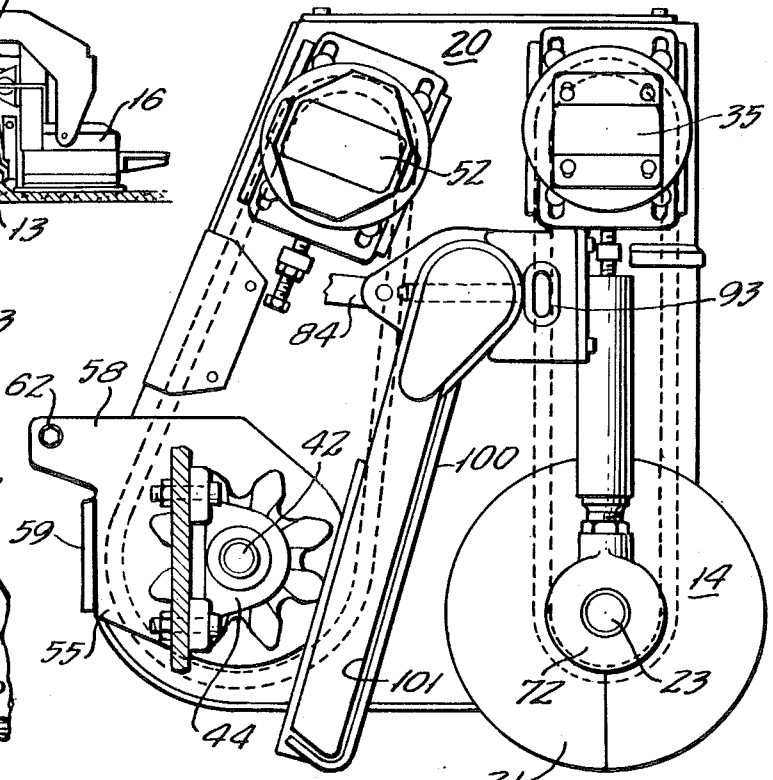
FIG. 3 is a side elevational view, partly in section, of the auger mounting and drive mechanism of FIG. 2.
Figure 2:
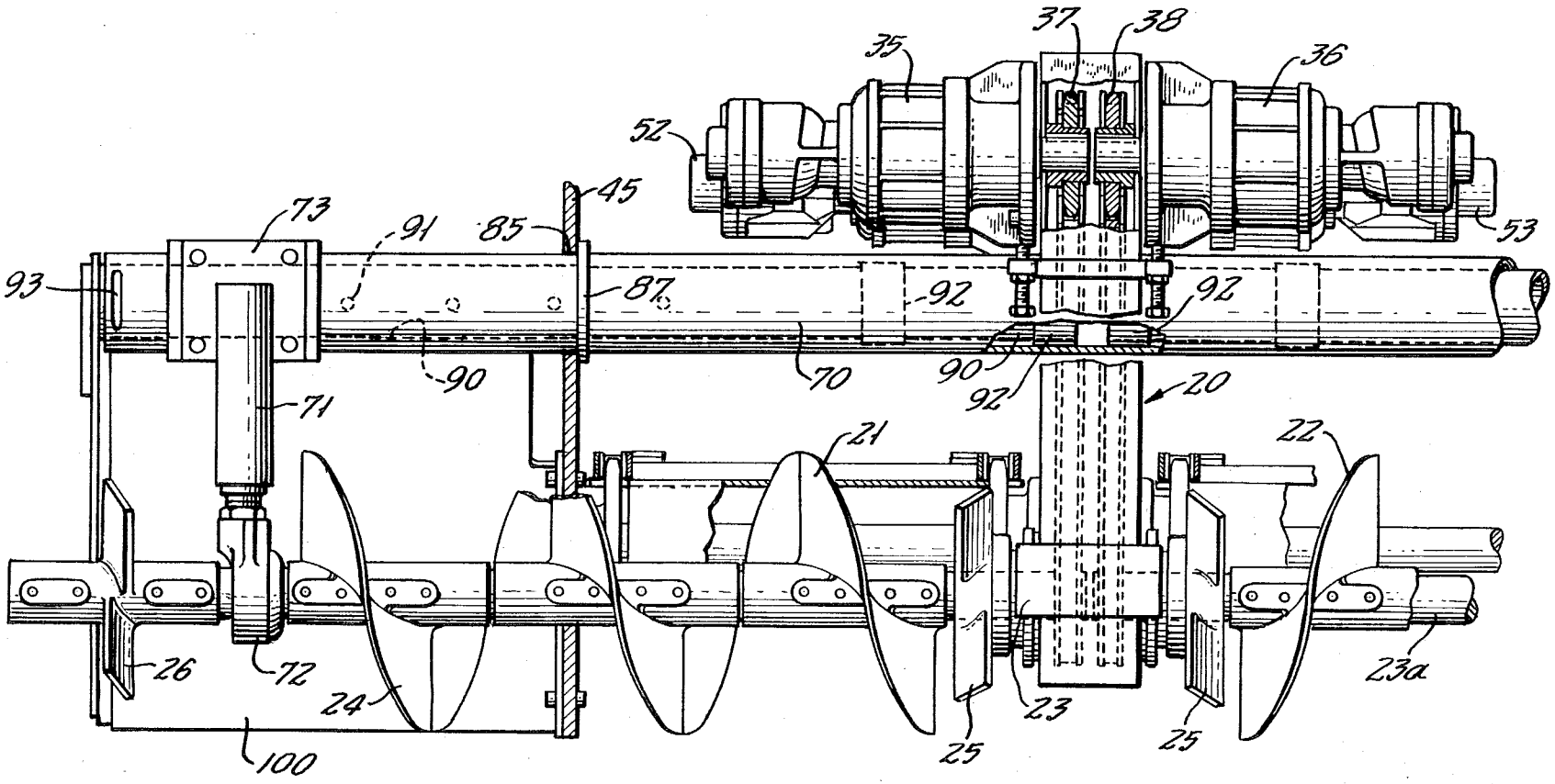
FIG. 2 is an enlarged, fragmentary elevational view, looking forward, of an auger mechanism used in the paver of FIG. 1 and incorporating the features of the invention.
Figure 6:
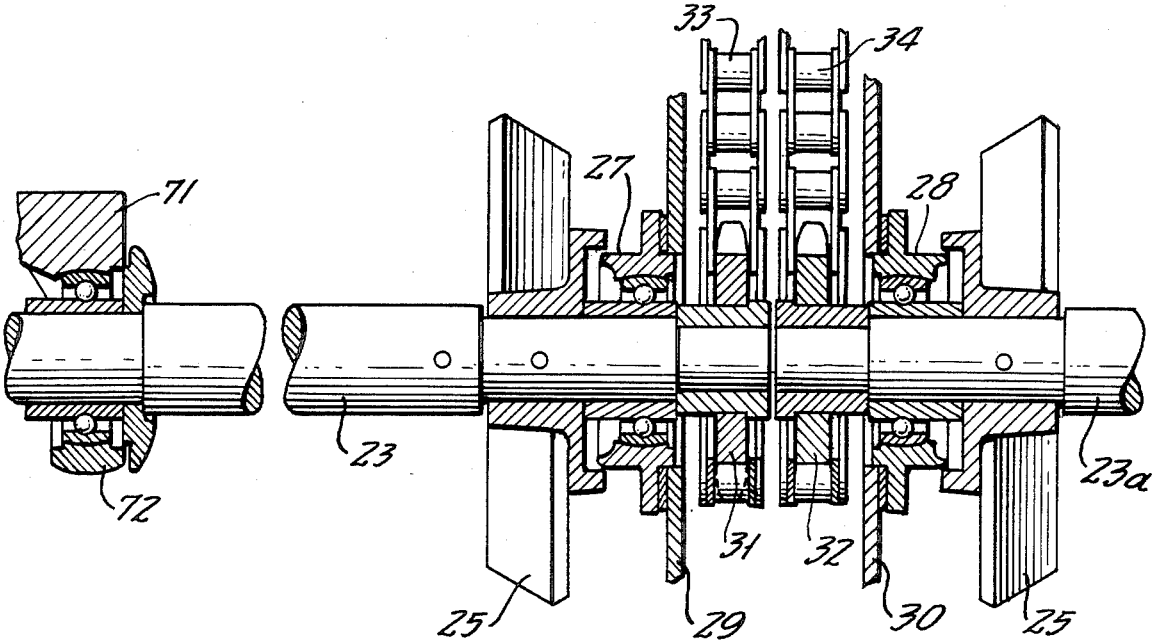
FIGS. 6 and 7 are enlarged, fragmentary cross sectional views as taken generally on lines 6—6, 7—7 respectively of FIG. 3.

As indicated in FIG. 6, the inboard ends of the auger shafts 23,23*a* are supported in bearings 27,28 secured to spaced side plates 29,30 of the drive box 20. The extremities of the auger shafts 23,23*a* project into the drive box and have fixed thereto respective drive sprockets 31,32 driven by chains 33,34. The chains in turn are driven by hydraulic motors 35,36 mounted at the upper rear portions of the drive box 20, as shown in FIGS. 2 and 3, and carrying sprockets 37,38. The motors 35,36 may advantageously be fixed displacement hydrostatic motors, driven by variable displacement hydrostatic pumps (not shown) to provide variable speed operation of the augers, usually by means of a control responsive to the height of the pile of asphalt in the region of the augers.

Figure 7:
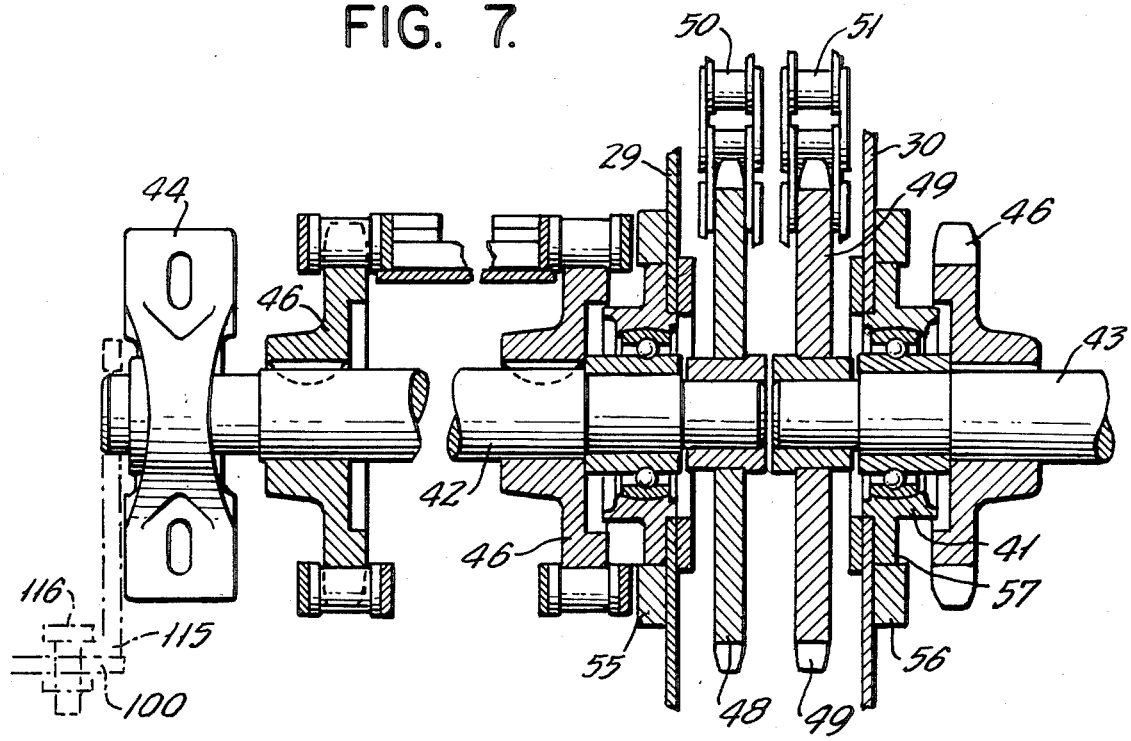

At the lower forward portion of the drive box 20 there are mounted bearing 40,41, bolted or otherwise secured to the respective sidewalls 29,30 of the drive box. These bearings support drive shafts 42,43 for left and right side slat conveyors (not shown) for moving asphalt from the hopper 10 at the front of the paver back to the area of the auger 14. As illustrated in FIG. 7, the outboard ends of the shafts 42,43 are supported by pillow blocks 44 bolted to a member 45*a* of the paver frame (see FIG. 3) immediately outboard of side plates 45 forming part of the paver tractor frame. Between the bearings 40,41 and the respective outboard pillow blocks 44, each of the conveyor drive shafts mounts a pair of spaced conveyor drive sprockets 46 arranged to engage chains 47 forming part of the slat conveyor.

Within the drive box, the respective conveyor shafts 42,43 mount drive sprockets 48,49 driven by chains 50,51 from independent hydraulic motors 52,53 mounted at the upper portions of upper forward portions of the drive box 20. As in the case of the auger drive motors 35,36, the conveyor drive motors 52,53 may be controllably driven by variable displacement hydrostatic pumps (not shown), under either automatic or manual control, so as to deliver paving material to the augers an appropriate rate in relation to its utilization in the paving process.

To advantage, the drive box 20 is pivotally mounted at the back of the paver by means of a pair of saddle brackets 55,56, which are received over the circular flanges 57 of the inner shaft bearings 40,41 (see FIG. 7). The flanges 57 are of circular outline and are received within circular openings in the respective saddle brackets 55,56, so that relative pivotal movement is permitted. At their forward ends, the saddle brackets are provided with respective forwardly projecting flanges 58 and laterally outwardly projecting flanges 59. The latter are secured by bolts 60 to a transverse channel member 61 forming part of the machine frame, while the former, 58, are secured by bolts 62 to another fixed part of the machine frame. The arrangement is such that the entire drive box and auger mechanism is supported by the saddle brackets 55,56 for pivotal movement about the common axis of the conveyor drive shafts 42,43.

As illustrated best in FIG. 2, the auger mechanism of the invention includes a horizontally disposed tubular beam 70, which extends through the walls of the drive box 20 and is secured thereto as by welding. The tubular beam extends in cantilever fashion outward over the top of the auger sections 21,22, approximately to the outer ends of the respective auger shafts 23,23*a*. Adjacent the outer end of the tubular beam, on each side, is an outboard support bearing structure 71, which includes a shaft bearing 72, directly supporting the auger shaft 23,23*a* and a mounting bracket 73 welded to the tubular support beam 70. The structural arrangement of the drive box, tubular beam and augers, as can be observed in FIG. 2, is of a self-contained, modular nature, which greatly facilitates mounting and removal of the mechanism from the tractor frame and thus simplifies assembly on maintenance procedures.

Figure 4:
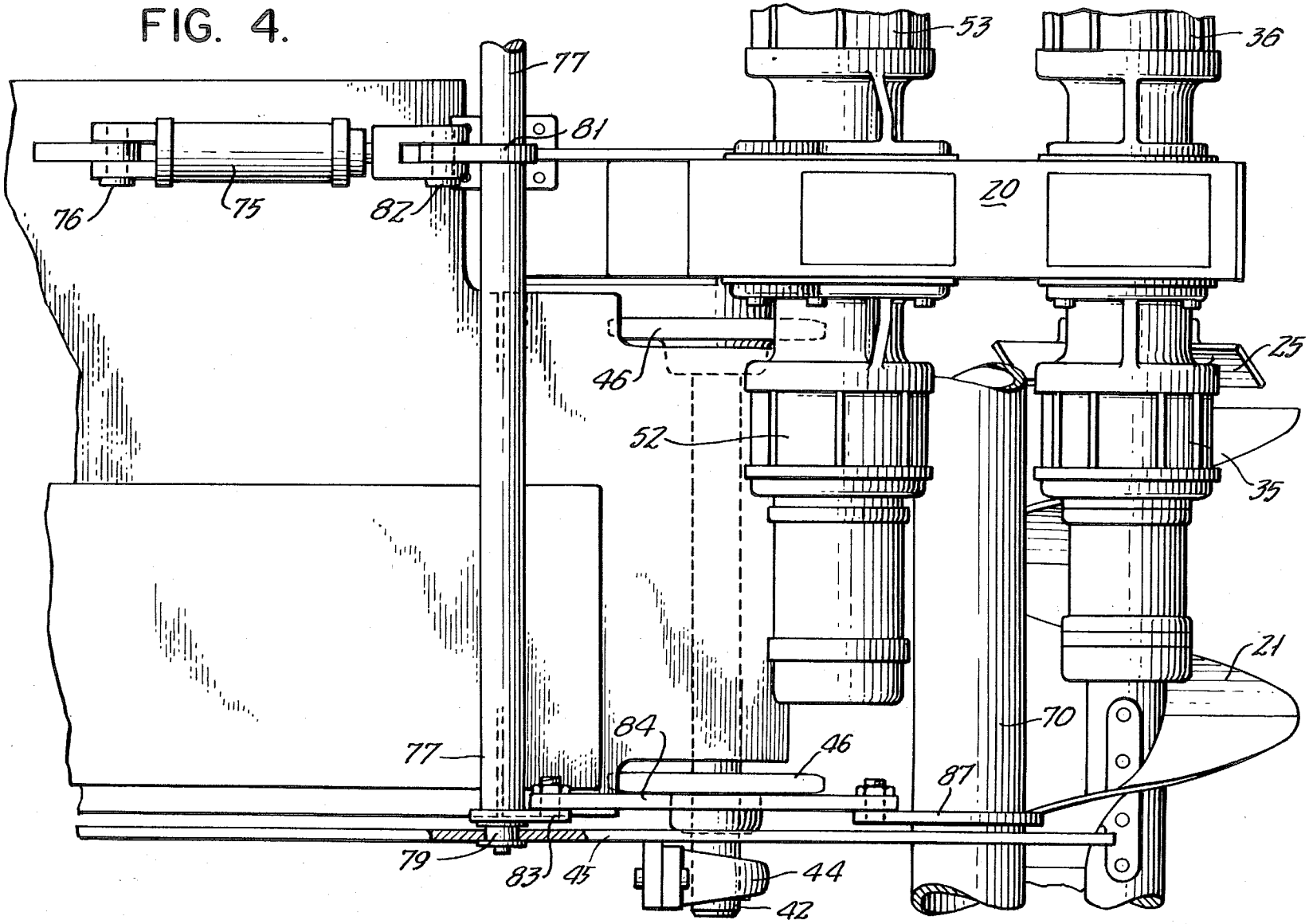
FIG. 4 is an enlarged, fragmentary top plan view of the new auger mechanism.
Figure 5:
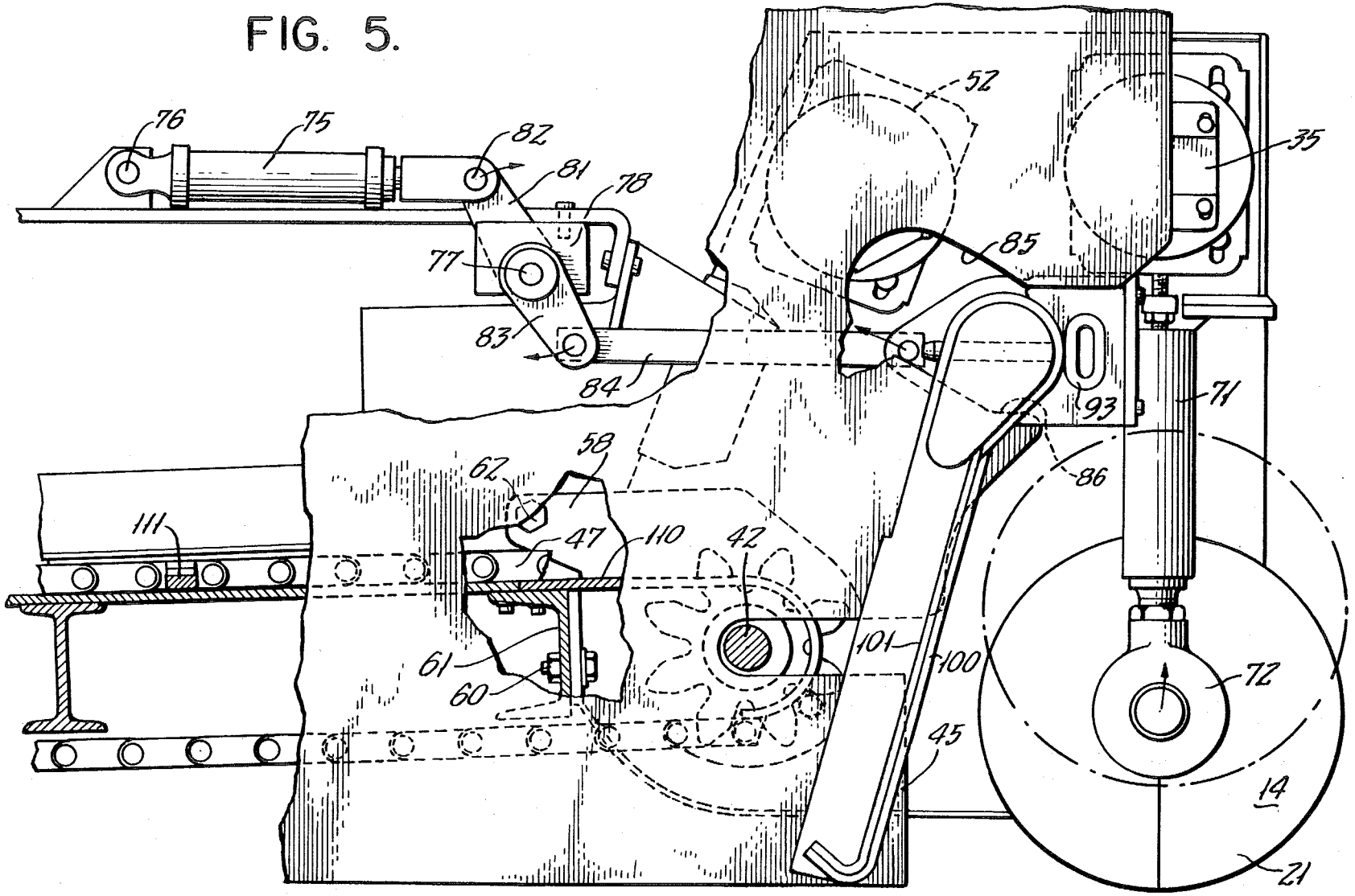
FIG. 5 is an enlarged elevational view, partly in section, showing the new auger mechanism mounted at the back of a paver frame and illustrating hydraulic actuator means for raising and lowering the auger relative to the paver frame and roadway surface.

As reflected in FIGS. 4 and 5, limited pivoting movement of the drive box 20 about the axis of shafts 42,43, and hence generally vertical movement of the auger elements themselves, is effected by means of an hydraulic actuator 75 pivotally mounted at 76 to the machine frame. A rocker shaft 77 is pivoted on the machine frame, centrally by means of a bracket 78 and at each end extremity in the frame side plates at 79. In its central area, the rocker shaft 77 mounts a lever 81, which is pivotally connected at 82 to the actuator 75. Adjacent each of its end extremities, the shaft 77 mounts outboard levers 83, which are joined by connecting links 84 to the outer end areas of the tubular support beam 70. When the actuator 75 is extended, the shaft 77 rotates clockwise, as viewed in FIG. 5, drawing the tubular beam 70 toward the back of the paver, and thus causing the entire mechanism, including the drive box 20, auger assembly 14 and tubular beam 70 to pivot about the axis of the conveyor shafts 42,43. This pivoting action, as is evident in FIG. 5, will translate into generally vertical motion of the auger assembly 14.

Stabilization of the auger and auger drive module is achieved in part by the attachment of the connecting links 84 to outboard ends of the tubular beam 70. In addition, mechanical stabilization is provided by means of generally arcuate slots 85, formed in the structural side plates 45 of the paver tractor (see FIG. 5). In general, the slots 85 are formed on a radius about the axis of the conveyor shafts 42,43 and serve generally to confine movement of the outboard ends of the tubular beam 70, while accommodating the desired motion thereof as a result of pivotal movement of the drive box. Adjacent the open outer end, the slot 85 may be provided with a generally horizontal surface 86 upon which the tubular beam 70 may directly rest when the hydraulic actuator 75 is deenergized.

In normal operation of the paving equipment, the augers 21,22 serve to push asphalt laterally outward. For a variety of reasons, the momentary individual loading upon the left and right side augers may vary, such that the net side thrust of the augers may vary more or less continuously and may shift from side to side in terms of direction. In the illustrated form of the invention, this variable side thrust is partly absorbed by means of abutment collars 87 mounted on the tubular beam 70 at each side and cooperating with the frame side plates 45. Thus, the abutment collars 87 are somewhat larger in diameter than the width of the guide slots 85, so that any tendency for the tubular cantilever beam to be driven to one side or the other by unbalanced forces from the augers 21,22, causes one or the other of the collars 87 to abut against the frame plate 45. This serves to reduce the side loads placed upon the saddle brackets 55,56, as will be understood.

Figure 8:
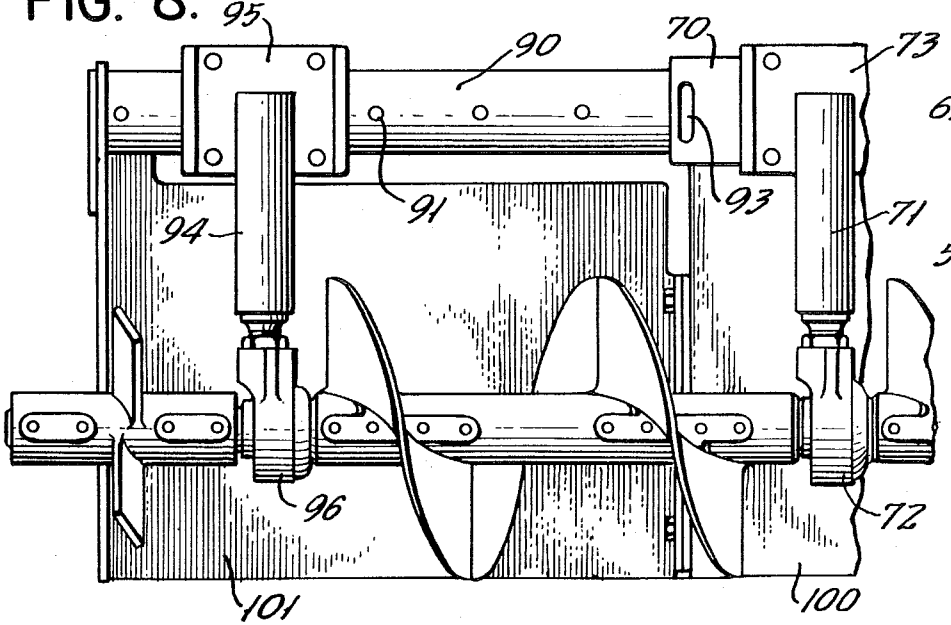
FIG. 8 is a back elevational view, similar to that of FIG. 2, showing an extended form of auger and auger support.

In typical operation, a paver must be adaptable to paving of various widths, from the width of the paver itself, as a typical minimum, to a maximum width significantly wider than the paver. For such applications, it has been typical practice to provide width extensions for the screed and auger assemblies, enabling the paving material to be spread laterally to a greater distance and then smoothed and flattened by the wider screed. In the apparatus of the present invention, extension of the auger mechanism is accommodated by providing for a telescoping outer section of the tubular beam 70. Referring particularly to FIG. 8, the reference numeral 90 represents a tubular beam extension arranged to slide internally of the main tubular beam 70. In the illustrated arrangement, the beam extension 90 is provided along its length with a plurality of spaced through openings 91, enabling the extension to be secured in a variety of extended position, by means of a pull pin 93 inserted in a pair of openings in each end of the main tubular beam 70. A pair of spaced annular bearing collars 92, near the inboard end of the extension 90, provide for a smooth sliding fit of the respective tubular membes 70,90.

In part, the lateral extension of the tubular beam 70 serves to extend laterally a guard means which is provided in front of the auger elements. In addition, if the auger extension is great enough, it is necessary to provide for additional outboard bearing support. Such additional bearing support is illustrated in FIG. 5, where the bearing support 94, similar to the previously described bearing support 71, is clamped to the beam extension 90 by a clamping block 95 and carries a shaft bearing 96 at its lower end for engagement with an outboard extension of the auger shaft.

As reflected in FIGS. 2, 3 and 8, a first guard plate 100 is welded or otherwise secured to the outboard portion of the main beam 70, on each side of the paver, providing a front guard for the outboard section of a minimum length auger. The inboard sections of the augers do not require a special guard as they are located directly behind the paver and of course they must be open to the discharge ends of the conveyor means carrying asphalt rearward from the front hopper. As shown particularly in FIG. 3, the inner guard plate 100 extends downward and is bent forwardly and slightly upward at its lower terminal end. Nested in front of the plate 100 is a second guard plate 101, which is attached to the outer end extremity of the tubular beam extension 90 and extends inwardly from the end of the beam extension. When the beam extension is fully retracted, as shown in FIG. 2, its guard plate 101 simply slides over the front of the main guard plate 100. In any projected position of the beam extension, its guard plate 101 moves outwardly with it, partially overlapping with the main guard plate 100, until the member 90 reaches the limit of its extension.

In the normal operation of the paver, the actuator 75 typically would be actuated to the position shown in FIG. 5, causing the auger sections 21,22 to be generally in their lower limit positions. In this position, the lower extremity of the auger elements would ride a few inches above the prepared road surface, sufficient to avoid damaging contact of the auger with the road surface during normal operations. Upon meeting any obstruction, such as a manhole projection, the entire auger mechanism can be easily raised by appropriately energizing the hydraulic actuator 75, pivoting the entire drive box, beam assembly etc. and raising the auger elements themselves in a generally vertical direction. Heretofore, the presence of such a manhole projection in the path of the paver and projecting above the lower limit of the auger has represented a very serious obstacle to the movement of the paver. Further, in this respect, the performance of high quality paving requires a steady, continuous forward movement of the paver in order to maintain proper floatation of the floating screed. Any significant speed reduction, and particularly stoppage, can cause an undesirable variation in the pavement mat, involving extra expense and degradation of machine performance.

As reflected in FIG. 1, the location of the auger mechanism is well behind the rear wheels of the paver, or behind the tracks of the paver, if a track laying version is being utilized. As a result, when it is time to load or unload the paver to or from a low boy trailer, in order to move the paver from one job site to another, even a slight upward tilting of the paver, as it begins to ascend an inclined ramp to the trailer body, tends to cause the augers 14 to contact the road surface. With conventional equipment, this has been a cause of considerable problem and damage to the auger mechanism. With the mechanism of the invention, however, all that is necessary is to energize the hydraulic actuator 75, lifting the augers through a full vertical stroke of five to six inches and clearing the augers out of harms way for loading and unloading.

The mechanism of the invention is also highly beneficial for relatively higher speed, over the road travel of the paver when moving from one location to another in a non-paving mode. Particularly with the rubber tired version of the paver, which is preferred by many contractors, high speed movement of the paver can be accompanied by considerable bouncing on the pneumatic rear tires, which are purposely under inflated to provide a broad footprint for paving. Thus, damage to the augers is always a potential problem with conventional pavers moving in the travel mode. With the mechanism of the invention, however, a simple control operation by the driver raises the augers out of the way sufficiently for safe travel.

In this respect, while as a theoretical matter it has been possible to raise the mounted position of an auger assembly on a paver in the past, the task has been so difficult and time intensive that, as a practical matter, a road contractor simply will not devote the time and manpower necessary to do the job.

An additional benefit of the new auger and auger drive mechanism is its essentially modular construction. For example, in order to install the auger mechanism, the entire modular unit can be engaged by a forklift truck and brought to the back of the paver (the screed at this time having been dropped from the paver). The saddle brackets 55,56 are first attached to the paver frame, by means of the bolts 60,62. Thereafter, the connecting links 84 are attached and the outer pillow blocks 44, at the outer ends of the conveyor drive shafts 42,43, are bolted to the machine frame. Finally, a curved guard plate 110 (FIG. 5) is installed over and around each of the conveyor drive shafts 42,43 to provide guidance and support for the slat conveyor elements 111 as they round the sprockets 46. The job also can be performed without a forklift, by properly blocking the auger mechanism at the desired height and then backing the paver into position for assembly.

Complete removal of the unit for periodic servicing and maintenance is also a highly simplified procedure, being essentially the reverse of that described for the installation. It will be noted, in this respect, that the side frame plates 45 of the paver are provided with rearwardly opening slots to receive the outer end extremities of the conveyor drive shafts.

To advantage, the guard panel 100 depending from the tubular beam elements 70 may be provided with openings for the mounting of a temporary support bracket 115 (see schematic representation in FIG. 7). Thus, during the initial assembly of the auger and auger drive module, the outboard ends of the conveyor drive shafts 42,43 may be supported in temporary support brackets secured by bolts 116 to the front face of the panels 100. The bolts 116 for temporary brackets 115 are removed when the pillow blocks 44 are secured to the machine frame. This enables the auger/drive module to be handled easily, without excessive concern for damaging of the drive shafts and/or bearings therefor.

The new auger and auger drive mechanism, thus not only enables significantly superior performance of the paving equipment in the course of its normal operations, but also enables significant advantages to be realized in assembly/disassembly operations, and substantial economies thereby to be realized in connection with maintenance and servicing of the equipment.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. In an asphalt paver or the like of the type having a self-propelled tractor, screed means trailed by said tractor, and power driven auger means, independent of said screed means, mounted at the rear of said tractor for distributing paving material laterally in front of said screed means, said paver having at least certain operating configurations in which said screed means and said auger means are substantially wider than said tractor, the improvement characterized by (a) an auger drive box mounted at the rear of said tractor generally centrally between its sides, (b) said auger means comprising left and right side augers, (c) the respective inboard ends of said augers being rotatably supported and drivingly engaged by said drive box, (d) means mounting said drive box to said tractor for limited pivotal movement about a generally horizontal pivot axis generally parallel to and forward of said augers, whereby pivotal movement of said drive box results in generally upward/downward movement of said augers, (e) cantilever-mounted support members carried by said drive box and extending laterally in opposite directions therefrom above said augers, (f) said augers and said support members, at least in certain operating configurations of said paver, extending laterally beyond the side limits of said tractor, (g) bearing members extending downward from the outboard ends of said support members and rotatably supporting outboard portions of the respective augers, and (h) controllable power actuator means for pivoting the assembly comprising said drive box, cantilever-mounted support members and augers about said pivot axis.

2. An asphalt paver according to claim 1, further characterized by (a) said support members being engaged and movably supported by said tractor at support points spaced outward from and on opposite sides of said drive box, (b) said support members extending laterally outward of said support points and being movably supported by said frame at said support points for limited pivoting movement about said horizontal axis.

3. An asphalt paver according to claim 2, further characterized by (a) said tractor having a frame structure including spaced side frame members, (b) arcuate guide slot means formed in said side frame members for the movable reception, guidance and support of said support members.

4. An asphalt paver according to claim 3, further characterized by (a) said support members comprising a continuous beam extending laterally outward from opposite sides of said drive box, and (b) said beam being received within and guided by said guide slot means.

5. An asphalt paver according to claim 1, wherein said paver includes material hopper means in front portions thereof and left and right side conveyor means for moving said material controllably toward the rear for deposit in the regions of the respective left and right side augers, further characterized by (a) conveyor drive shaft means extending laterally from opposite sides of said drive box and driven thereby, (b) means for rotatably supporting said conveyor drive shaft means on said tractor, (c) the assembly including said drive box, said support members and said augers being mounted for limited pivoting movement about the axis of said conveyor drive shaft means.

6. In an asphalt paver or the like of the type having a self-propelled tractor, screed means trailed by said tractor, and power driven auger means, independent of said screed means, mounted at the rear of said tractor for distributing paving material laterally in front of said screed means, said paver having at least certain operating configurations in which said screed means and said auger means are substantially wider than said tractor, the improvement characterized by (a) an auger mounting member mounted at the rear of said tractor generally centrally between its sides, (b) said auger means comprising left and right side augers, (c) the respective inboard ends of said augers being rotatably supported by said mounting member, (d) means securing said auger mounting member to said tractor for limited pivotal movement about a generally horizontal pivot axis generally parallel to and forward of said augers, whereby pivotal movement of said mounting member results in generally vertical movement of said augers, (e) a cantilever-mounted support beam carried by said mounting member and having portions extending laterally from opposite sides thereof above said augers, (f) said augers and said support beam, at least in certain operating configurations of said paver, extending laterally beyond the side limits of said tractor, (g) bearing members extending downward from the outboard ends of said cantilever support beam and rotatably supporting outboard portions of the respective augers, and (h) controllable power actuator means for pivoting the assembly comprising said auger mounting member, said support beam and auger about said pivot axis.

7. An asphalt paver according to claim 6, further characterized by (a) said controllable power actuator means comprising connecting means engaging said cantilever beam at widely spaced points, generally within the side limits of said tractor, on opposite sides of said auger mounting member, and (b) a power actuator operating said connecting means for moving said assembly.

8. An asphalt paver according to claim 7, further characterized by (a) said connecting means comprises a rocker shaft mounted on the paver and connecting links extending from said rocker shaft to said cantilever beam at spaced points, (b) said power actuator being connected to effect limited rotation of said rocker shaft.

9. An asphalt paver according to claim 6, further characterized by (a) means on said paver movably engaging said support beam at points spaced outward from said auger mounting member and substantially inward from the outer extremities of said support beam to stabilize said beam relative to said paver.

10. An asphalt paver according to claim 9, further characterized by (a) said means for movably engaging comprising spaced side frame members of said paver, (b) said side frame members having arcuate guide slot means therein slideably engagable with said support beam throughout the range of its operative positions.

11. An asphalt paver according to claim 9, further characterized by (a) said means for movably engaging comprising a transverse rocker shaft mounted on the paver and connecting links extending from said rocker shaft to said support beam.

12. An asphalt paver according to claim 6, further characterized by (a) said mounting member comprising a drive box, (b) means on said drive box for driving the respective augers.

13. An asphalt paver according to claim 12, further characterized by (a) said drive box supporting and drivingly engaging material conveyor shafts extending coaxially from opposite sides, (b) said drive box being mounted for pivoting movement about the axis of said conveyor shafts.

14. An asphalt paver according to claim 13, further characterized by (a) a pair of saddle brackets pivotally associated with said drive box and removably bolted to the frame of said paver, and (b) outboard bearing means for said conveyor shafts removably bolted to said paver.

15. An asphalt paver according to claim 6, further characterized by (a) cooperative abutment means on said cantilever support beam and on said paver for resisting unbalanced lateral thrust of said augers.

16. An asphalt paver according to claim 15, further characterized by (a) said paver having spaced side frame members provided with arcuate guide slot means for receiving and stabilizing said cantilever support beam, (b) said cooperative abutment means comprising abutment collar means on said cantilever support beam engagable with said side frame members adjacent said slots.

17. In an asphalt paver or the like of the type having a self-propelled tractor, screed means trailed by said tractor, and power driven auger means, independent of said screed means, mounted at the rear of said tractor for distributing paving material laterally in front of said screed means, said paver having at least certain operating configurations in which said screed means and said auger means are substantially wider than said tractor, the improvement characterized by (a) auger drive box means mounted centrally at the rear of said tractor, (b) said auger means comprising left and right side augers, (c) respective ends of said augers being rotatably supported and drivingly engaged by said drive box means, (d) means mounting said drive box means to said tractor for limited pivotal movement about a generally horizontal pivot axis generally parallel to and forward of said augers, whereby pivotal movement of said drive box results in generally vertical movement of said augers, (e) cantilever-mounted support members carried by said drive box means and extending laterally therefrom above said augers, (f) said augers and said support members, at least in certain operating configurations of said paver, extending laterally, beyond the side limits of said tractor, (g) bearing members extending downward from said support members and rotatably supporting portions of the respective augers at one or more locations remote from said drive box means, (h) the combination of said drive box means, said support members and said augers comprising a unitary structural module mounted on said paver, (i) controllable power actuator means for pivoting said module about said pivot axis.

18. An asphalt paver according to claim 17, further characterized by (a) said drive box means comprising a single drive box engaging the inboard ends of the respective left and right side augers, and (b) said support members comprising a cantilever beam mounted by said drive box and extending laterally from each side thereof.

19. An asphalt paver according to claim 18, further characterized by (a) said unitary structural module further including conveyor drive shaft means supported and drivingly engaged at their inboard ends by said drive box, (b) the outboard ends of said conveyor drive shafts being supported on said paver frame, and (c) means on said unitary module to enable the outboard ends of said conveyor drive shafts to be supported temporarily by said module.

20. An asphalt paver according to claim 19, further characterized by (a) said conveyor drive shafts being mounted on a common axis, and (b) said drive box means being mounted on said paver for pivotal movement about said common axis.

* * * * *